US010149597B2

(12) United States Patent
Alwin

(10) Patent No.: US 10,149,597 B2
(45) Date of Patent: Dec. 11, 2018

(54) CUTLERY BASKET FOR A DISHWASHER

(71) Applicant: ELECTROLUX APPLIANCES AKTIEBOLAG, Stockholm (SE)

(72) Inventor: Peter Alwin, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/894,678

(22) PCT Filed: Jun. 23, 2013

(86) PCT No.: PCT/EP2013/063381

§ 371 (c)(1),
(2) Date: Nov. 30, 2015

(87) PCT Pub. No.: WO2014/206459

PCT Pub. Date: Dec. 31, 2014

(65) Prior Publication Data

US 2016/0128543 A1 May 12, 2016

(51) Int. Cl.
*A47L 15/50* (2006.01)

(52) U.S. Cl.
CPC ..... *A47L 15/502* (2013.01)

(58) Field of Classification Search
CPC ..... A47L 15/502; A47L 15/503; A47G 21/14; A47J 45/02
See application file for complete search history.

(56) References Cited

U.S. PATENT DOCUMENTS 2,338,303 A * 1/1944 Rosenberg ..... A47G 21/14 211/70.3
3,934,728 A * 1/1976 Guth ..... A47L 15/505 211/41.9
D254,187 S * 2/1980 Freese ..... D32/3
4,318,478 A * 3/1982 De Winter ..... A47J 47/16 206/373
4,775,075 A * 10/1988 Kamin ..... G07G 1/0027 220/815
4,867,410 A * 9/1989 Jurgich ..... A47G 21/14 211/70.7

(Continued)

FOREIGN PATENT DOCUMENTS

DE 9216495 3/1994
DE 19624888 7/1997

(Continued)

OTHER PUBLICATIONS

Written Opinion from International Application No. PCT/EP2013/063381, dated Jul. 30, 2013.

(Continued)

*Primary Examiner* — Stanton L Krycinski
(74) *Attorney, Agent, or Firm* — Alston & Bird LLP

(57) ABSTRACT

The present invention describes a cutlery basket for a dishwasher that facilitates the use of a cutlery basket in particular allowing easier loading and unloading of cutlery into and out of the cutlery basket by providing a large opening on an outer upright wall of the cutlery basket. Preferred embodiments of the cutlery basket comprise movable lids that can be flipped parallel inside of the cutlery basket or flipped outside to provide extra space for storing cutlery.

19 Claims, 4 Drawing Sheets

(56) References Cited

U.S. PATENT DOCUMENTS 5,069,360 A * 12/1991 Dingier ..... A47L 15/502 220/488
5,287,984 A * 2/1994 Michael ..... A47L 15/502 220/555
5,431,294 A * 7/1995 Stottmann ..... A47L 15/502 211/181.1
D391,696 S * 3/1998 Bournay, Jr. ..... D32/3
5,881,906 A * 3/1999 Rogers ..... A47L 15/502 220/488
6,129,237 A * 10/2000 Miyahara ..... B65D 43/165 220/255
6,394,627 B1 * 5/2002 Lo ..... A47G 21/14 362/127
D487,825 S * 3/2004 Kim ..... D32/3
D502,295 S * 2/2005 Feddema ..... D32/3
7,073,682 B2 * 7/2006 Raches ..... A47L 15/502 220/488
7,694,844 B2 * 4/2010 Woo ..... A47L 15/502 211/70.7
D620,649 S * 7/2010 Eng ..... D32/3
7,861,883 B2 * 1/2011 Purushothaman .... A47L 15/502 206/553
8,151,810 B2 * 4/2012 House ..... A47L 15/502 134/135
8,168,006 B2 * 5/2012 Bengston ..... A47L 15/502 134/135
8,377,227 B2 * 2/2013 Bengston ..... A47L 15/502 134/135
8,522,998 B2 * 9/2013 Crookshanks ..... A47L 15/502 211/41.8
D701,358 S * 3/2014 Eng ..... D32/3
8,733,859 B2 * 5/2014 Shewmaker ..... A47L 15/502 211/41.9
8,840,202 B2 * 9/2014 Garnett ..... A47L 15/502 312/228.1
8,905,495 B2 * 12/2014 Garnett ..... A47L 15/502 312/228.1
9,004,083 B2 * 4/2015 Buhlmeyer ..... A47L 15/503 134/137
9,119,523 B2 * 9/2015 McDaniel ..... A47L 15/50
9,173,544 B2 * 11/2015 Ayvazoglu ..... A47L 15/502
9,226,643 B2 * 1/2016 Garnett ..... A47L 15/502
9,272,651 B1 * 3/2016 Maya ..... B60N 3/102
2002/0139809 A1 * 10/2002 Barry ..... A47L 15/502 220/762
2008/0272126 A1 * 11/2008 Crookshanks ..... A47L 15/502 220/486
2009/0277484 A1 * 11/2009 Jerg ..... A47L 15/4202 134/56 D
2014/0259381 A1 * 9/2014 Fogerlie ..... A47L 15/502 4/654
2014/0367387 A1 * 12/2014 Aro ..... A47L 15/502 220/488
2015/0053237 A1 * 2/2015 Lee ..... A47L 15/0021 134/18

FOREIGN PATENT DOCUMENTS

EP 0385877 9/1990
FR 2973669 A1 * 10/2012 ..... A47B 88/00
WO WO 2013098019 A1 * 7/2013 ..... A47L 15/502

OTHER PUBLICATIONS

International Search Report for International Application No. PCT/EP2013/063381 dated Jul. 18, 2013.
Communication under rule 71(3) EPC of Intention to Grant for European Patent Application No. 13732452.1 dated Nov. 28, 2016, 6 pages.
Office Action for Chinese Patent Application No. 201380076575.5 dated Nov. 16, 2017, with English translation, 13 pages.

* cited by examiner

CUTLERY BASKET FOR A DISHWASHER

CROSS REFERENCE TO RELATED APPLICATIONS

This application is a national stage entry of PCT/EP2013/063381 filed Jun. 26, 2013, which application is incorporated by reference herein in its entirety.

BACKGROUND OF THE INVENTION

Home appliances such as dishwashers are ubiquitous in daily life. Challenges for such devices arise from the competition and from modern life. It is a prerogative that dishwashers are using as few resources as possible. They have to be energy-efficient, provide good cleaning results with a minimum amount of water and last but not least have to be easily operable by the person using the dishwasher. Per se cutlery baskets for dishwashers are known in the art and everybody knows one from his experience.

The document EP 0 385 877 A deals with a problem that at common cutlery baskets the top part of the cutlery needs to be touched in order to remove the cutlery from the cutlery basket. This may case injury when touching sharp edges and degrades the cleaning result. To solve this problem the prior art proposes to have a partly open or openable or removable front wall of the cutlery basket.

Still a problem exists with removing small cutlery from inside the cutlery basket while at the same time providing support during the cleaning operation.

SUMMARY OF VARIOUS EMBODIMENTS

It is an object of the present invention to solve problems associated with current designs of cutlery baskets and to provide a cutlery basket that is easier to use and provides a better cleaning result.

This object is achieved by a cutlery basket according to claim 1.

Further developments of the invention are provided in the dependent claims.

An embodiment of a cutlery basket according to the present invention has the advantage that due to its large opening it is easier to access by an operator and in particular small cutlery such as mocha spoons or small forks can be easily loaded and unloaded in and out of the cutlery basket. In particular, this is possible without removing a cover of the cutlery basket. The presence of large openings allows for better cleaning results.

In a preferred embodiment of the cutlery basket according to the present invention, a lower area is provided with openings for better cleaning results. This has the advantage of still improved cleaning results by improved accessibility and less use of resources in terms of e.g. plastic material, while at the same time being adapted in their size to allow for the support of cutlery.

Beneficially, the compartment for accepting the cutlery is covered by a lid. In this manner, the cutlery basket according to an embodiment of the invention can be opened easily and the cutlery can be arranged more flexibly. Especially this holds true in an arrangement where the lid is folded outside of the compartment which extends the area where the cutlery can be placed in the dishwasher.

Beneficially, a cutlery basket according to a further embodiment of the present invention comprises a second wall and a guide for the lid that allows the lid to be arranged in a position parallel and proximal to the second wall. In this manner, the lid once unfolded does not obstruct the opening and allows for larger cutlery pieces to be put in the compartment while at the same time allowing full access of cleaning water.

Beneficially, a further development of an embodiment comprises an offset border at one of its walls in order to improve the structural integrity of the cutlery basket and to compensate for the large opening on the outside. In this manner, good accessibility is combined with a rigid structure and durability in daily use.

Further advantageously, according to an embodiment of the cutlery basket, the wall having an offset border is made thicker to provide an even more rigid structure.

Further advantageously, a thicker wall of the cutlery basket according to an embodiment of the present invention comprises the guide for the lid and thus ensures secure operation and guidance for the lid when it is folded and unfolded along the compartment.

Advantageously, a further development of an embodiment of the cutlery basket according to the present invention comprises a lid and a wall that engage mutually by a protrusion and a groove wherein the mutual engaging parts allow for a rotating and sliding movement of the lid. In this manner, either a groove can be provided in the lid and a protrusion in the sidewall or the wall can provide a groove and the lid can have protrusions that engage the groove in the sidewall. In this manner, a secure guiding of the lid can be provided while allowing for a great flexibility in the design of the mutually engaging parts.

Beneficially, a further development of an embodiment of the cutlery basket is shaped with a rectangular footprint and has a guide that runs parallel to the vertical side of the outer wall while the protrusion allows at least a 90° rotation of the lid. In this manner, the lid can be unfolded outside of the compartment and provide additional space for supplying cutlery be cleaned in the dishwasher.

Beneficially, a further development of an embodiment of a cutlery basket according to the present invention comprises two guides in particular in form of grooves or slots along the outer wall. Beneficially this provides for a secure connection between the lid and the cutlery basket and withstands many open and close operations during daily use.

Advantageously, according to a further development of an embodiment of the cutlery basket, the guide is provided in the outer wall in particular in form of a groove because this allows manufacturing a less complicated lid while at the same time providing a secure interconnection between the lid and the cutlery basket.

Beneficially, according to further developments of an embodiment of the cutlery basket, the guide is provided in form of a rail or a slot and/or the guide is L-shaped which allows for a telescopic movement of a lid along the upper horizontal edge of the cutlery basket and allows to arrange for a more secure support of the lid.

Beneficially, according to a further development of the cutlery basket according to the instant invention, the lid is made at least partially from soft material which allows it to give cutlery such a structural support, while at the same time allowing for a facilitated loading and unloading of the cutlery into the openings of the lid.

Advantageously, according to a further development of an embodiment of the cutlery basket of the instant invention, the lid can be folded outside of the compartment which accommodates the cutlery and in this manner allows for an extended area to support cutlery for cleaning in the dishwasher.

BRIEF DESCRIPTION OF THE SEVERAL VIEWS OF THE DRAWINGS

Subsequently, advantages of the invention will be explained on the basis of advantageous embodiments shown in figures wherein.

DETAILED DESCRIPTION

Figure 1:
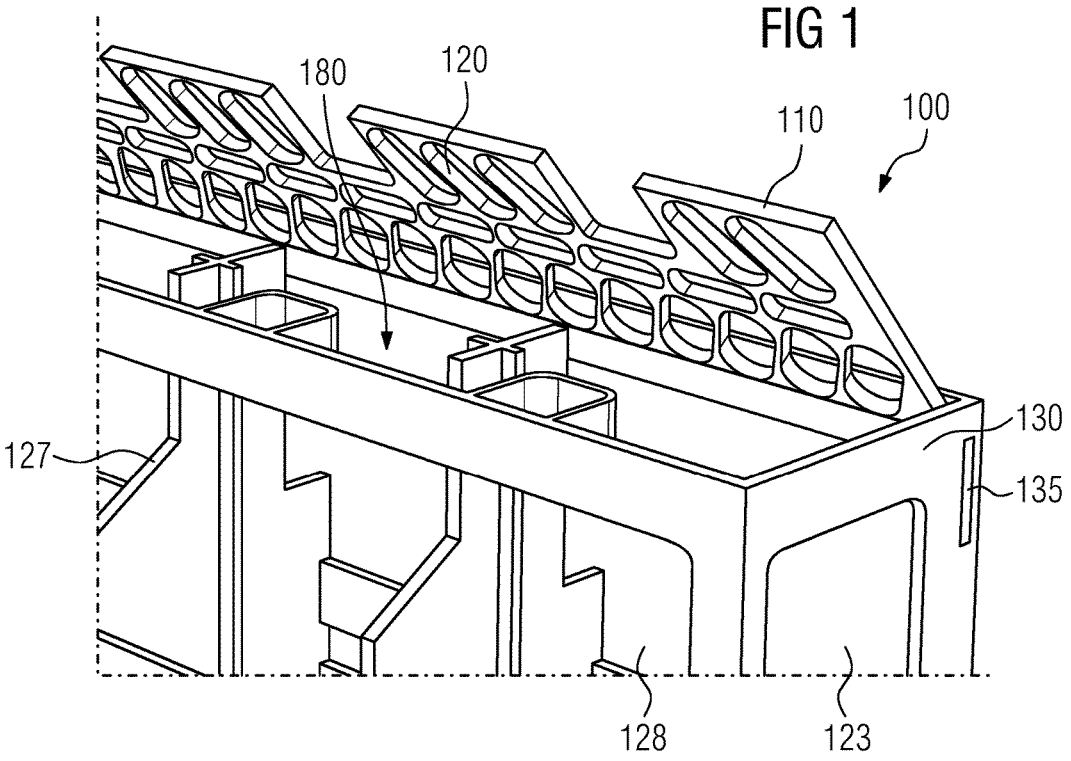
FIG. 1 shows a partial view of an embodiment of a cutlery basket.

Looking at FIG. 1 it shows a partial view of a cutlery basket according to an embodiment of the present invention. The cutlery basket 100 has a lid 110 that can be flipped about a horizontal axis and that is supported by a guide 135. The lid has openings 120 to support cutlery. Further, a second vertical wall 127 is shown and a larger opening 128 that is in a first upright wall. The applicant has found that such a larger opening 128 solves problems with accessibility of small cutlery inside a cutlery basket, since a user may reach into lower areas of the cutlery basket from a side. Moreover, another opening 123 is shown at a vertical sidewall of the cutlery basket 100.

Figure 2:
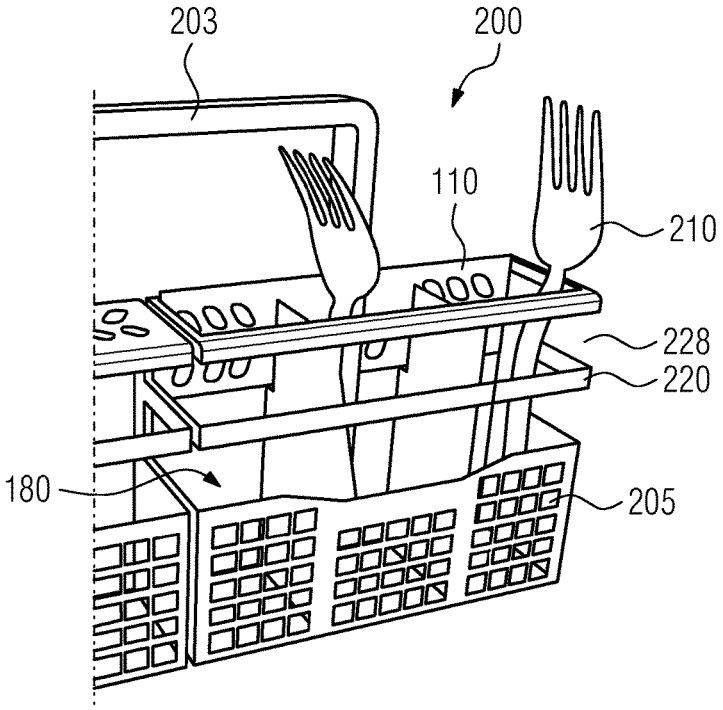
FIG. 2 shows a partial view of an embodiment of a cutlery basket.

FIG. 2 shows another view of a cutlery basket of an embodiment of the present invention. This cutlery basket 200 comprises a handle 203, a compartment 180 to accommodate cutlery, here shown in form of forks 210. In this embodiment, the cutlery basket is provided with a frame 220 which extends along the front and the side opening of the cutlery basket. The lid 110 covering this embodiment is divided in two halves and can be seen in its retracted position along and parallel to the rear vertical wall of the cutlery basket.

Also shown is a smaller opening 205 in the lower region of the vertical front wall of the cutlery basket.

Figure 3:
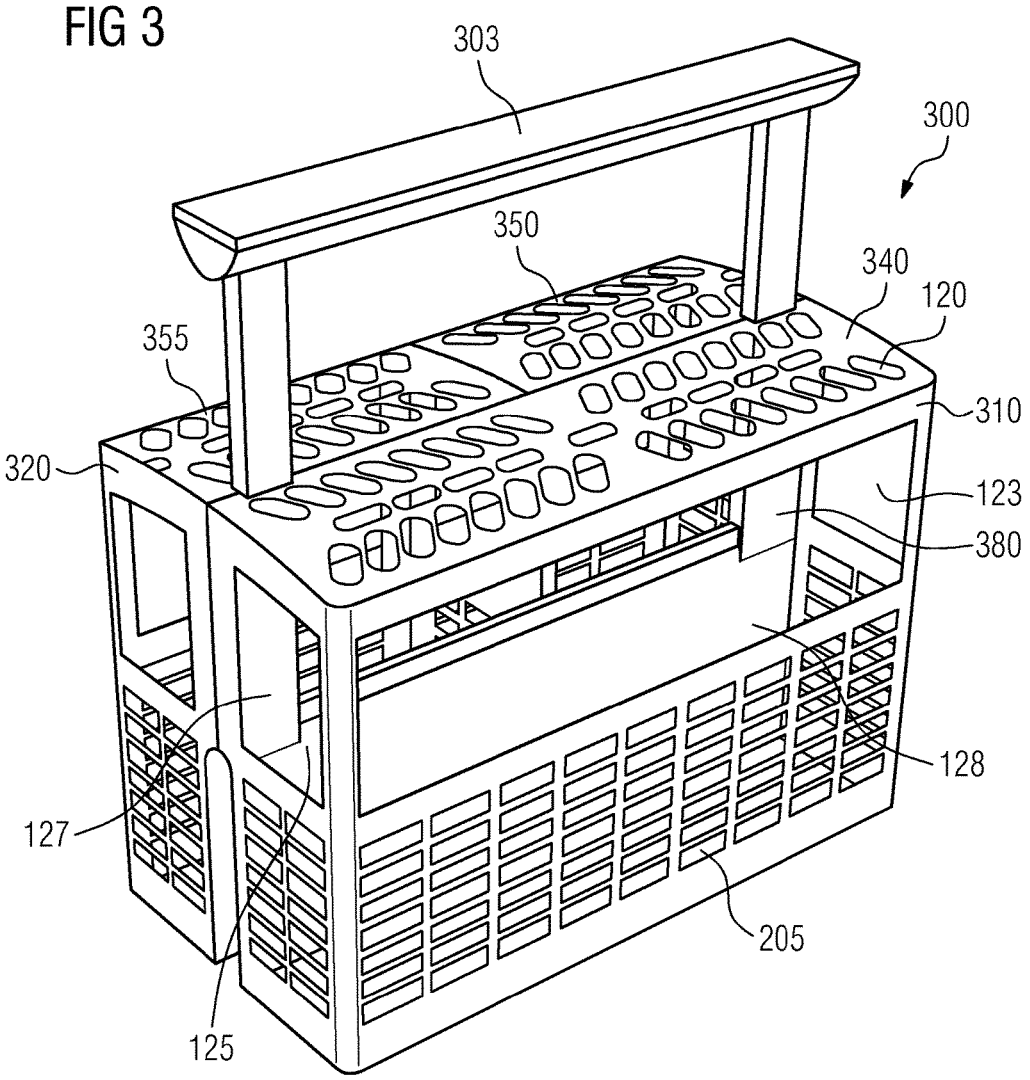
FIG. 3 shows a cutlery basket according to an embodiment of the present invention.

FIG. 3 shows a view of another embodiment of a cutlery basket 300 according to the present invention. In its elegant design it may be considered as a preferred embodiment of the invention. This cutlery basket comprises a handle 303. The first vertical wall 310 has a large opening 128 which occupies about half the area of the vertical wall and in particular 40 to 60%, preferably 45 to 55%; and even more preferably 50% of this area. It has smaller openings 205 which support the cutlery and at the same time allow washing water to pass through.

Further, the cutlery basket comprises lids 340, 350 and 355 which extend along the total length 350 or half of the length 350, 355 of the cutlery basket. In some cases, the cutlery basket may be adapted to be divided into two separate compartments to allow to be arranged in different areas of the dishwasher. The lid 340 has openings 120 to allow cutlery to be entered through this openings and to be accommodated in the compartment inside the cutlery basket 300. One of the upright walls 127 has an offset border 380.

It can also be seen that the sidewalls of the cutlery basket 300 have openings 123 and 125 that allow easier access from all sides of the cutlery basket to smaller cutlery which in particular is shorter than the distance between the lid 340 and the base of the cutlery basket.

Figure 4:
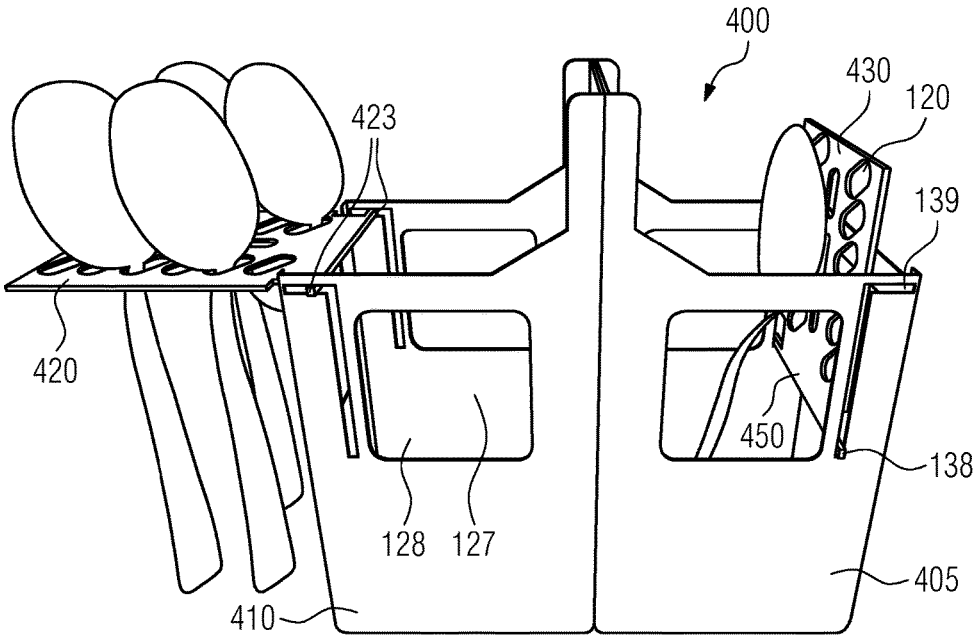
FIG. 4 shows another embodiment of a cutlery basket according to the present invention.

FIG. 4 shows another embodiment of a cutlery basket 400 according to the present invention. Here, the cutlery basket is e.g. comprised of two halves 405 and 410. It comprises two lids 420 and 430 that can be arranged parallel to an outer wall of the cutlery basket as shown in 430 when folded inside the cutlery basket 405 and also can be flipped outside the compartment to accommodate cutlery in the cutlery basket as shown at 420.

FIG. 4 also shows an L-shaped slot in two parallel walls of the cutlery basket that guides the lid 420 and 430 along its movement when flipping it to the outside respectively retracting it.

The slots are complemented by two journals 138 that engage a respective slot. The lid has openings 120 and a lower edge 450. In its retracted position, the lid 430 in this embodiment still extends beyond an upper horizontal edge of the cutlery basket 400.

Figure 5:
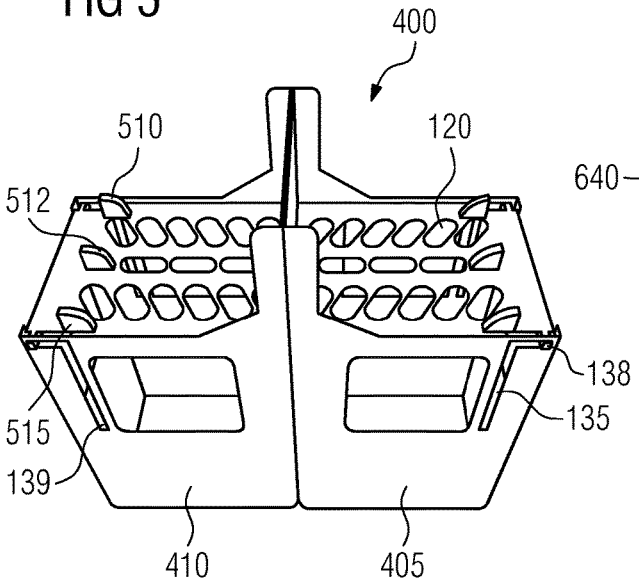
FIGS. 5 and 6 show different arrangements of the cutlery basket of FIG. 4.

FIG. 5 shows another view of the embodiment shown in FIG. 4. In this representation, the lids 420, 430 in FIG. 4 cover the compartment of the cutlery basket 400. FIG. 5 also shows a slot 139 that engages with a journal 138 which forms part of a respective lid. FIG. 5 also shows protrusions 510, 512 and 515 that support the lid when it is folded outside against the outer wall of the cutlery basket 400.

Figure 6:
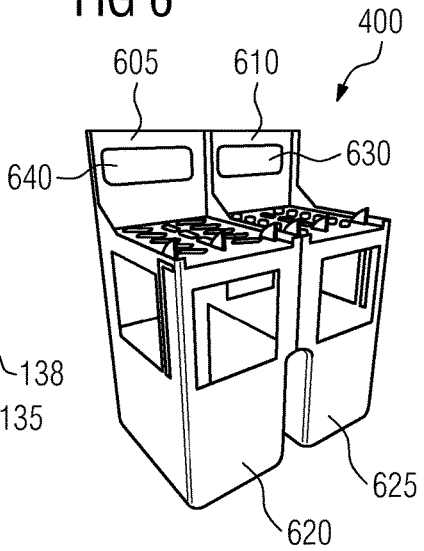

FIG. 6 shows another view of the cutlery basket 400 shown in FIG. 4. Here, the cutlery basket is e.g. folded in a manner that the two halves 410 and 405 are positioned side by side against each other and sidewalls 620 and 625 not visible in FIG. 4 now face forward. Also two handles 605 and 610 are shown that correspond to openings 630 and 640. At FIGS. 5 and 4, openings 630 and 640 are arranged against each other, and also handles 610 and 605 are facing each other thus forming one handle in the middle of the cutlery basket 400.

Figure 7:
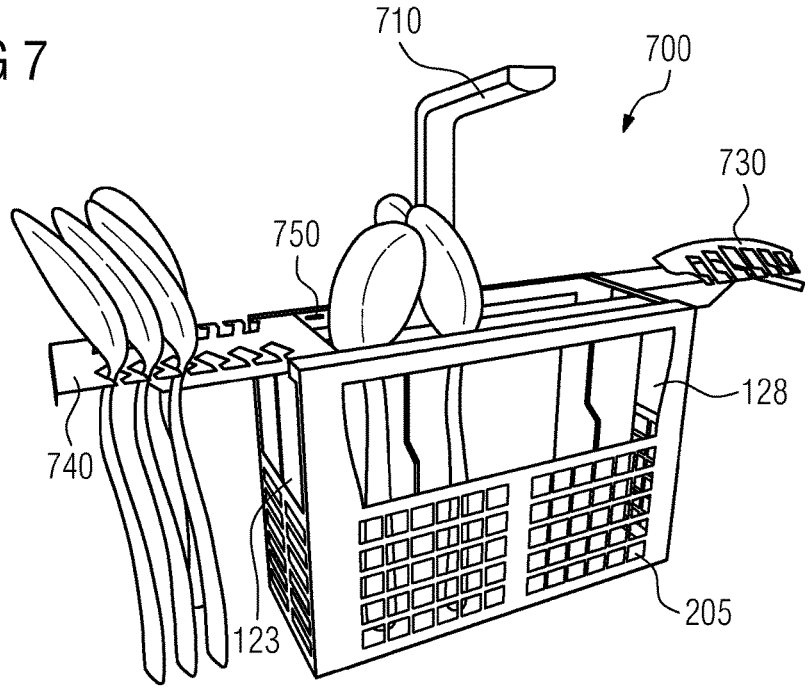
FIG. 7 shows another embodiment of a cutlery basket according to the present invention.

FIG. 7 shows another embodiment of a cutlery basket according to the instant invention. It has a handle 710 and two lids 730 and 740. The lid 730 is shown to be made at least partly of flexible material which may accommodate cutlery and allows facilitating loading and unloading of the cutlery. Further, small openings 205 in the lower region of the first upright wall are shown. Also side openings 123 and 128 can be identified. Reference sign 750 marks a guide e.g. for horizontal movement of the lid 740, which also may be provided for lid 730.

Figure 8:
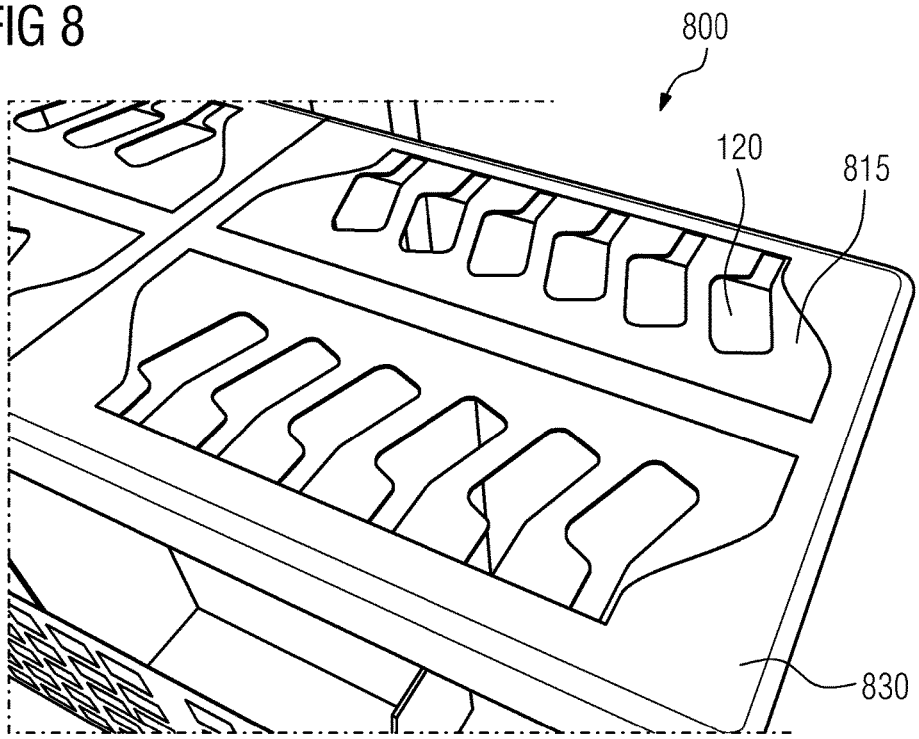
FIG. 8 shows another partial view of the embodiment shown in FIG. 7.

FIG. 8 shows a partial view of a cutlery basket 800 according to another embodiment of the instant invention. In this case, a lid 830 of the cutlery basket 800 has openings 120. These openings are e.g. provided in an area comprised of soft material 815. Cutlery can be entered into the soft material by means of the opening 120 that flexibly adopts to the outer contour of the cutlery and supports it during the washing procedure. The flexible material allows for facilitated loading and unloading of the cutlery into the cutlery basket.

LIST OF REFERENCE NUMERALS

100,200,300,400,700,800 cutlery basket
110,420,430,730,740,830 lid
127 second upright wall
125,123 large openings
130 sidewall

135 guide
138 journal
139 L-shaped slot
203 handle
180 compartment
228 large opening
220 frame
205 small opening
210 cutlery (fork)
303 handle
350,355 small lid
340,310 first upright wall
380 wall with offset border
405,410 half cutlery basket
450 lower edge
423 L-shaped slot
510,512,515 protrusions to support the lid
625,630 sidewalls of the cutlery basket
605,610 handles
630,640 openings
710 handle
750 guide
730,740 flexible lids
815 area made of soft material

The invention claimed is:

1. A cutlery basket for a dishwasher at least comprising:
a first upright outer wall defining an outside border of a compartment to accept cutlery,
the first upright outer wall in a first upper region having a first opening having the size of 40-60% of the first upright outer wall, the first opening providing access to an interior of the compartment, and
the first upright wall in a second lower region has plural openings of a size allowing to support the cutlery,
wherein the first upright wall includes a first lateral edge; and
a sidewall defining a second outside border of the compartment,
the sidewall in a first upper sidewall region having a first sidewall opening having the size of 40-60% of the sidewall, the first sidewall opening also providing access to the interior of the compartment,
the sidewall in a second lower sidewall region has plural sidewall openings of a second size allowing to support the cutlery,
wherein the sidewall includes a second lateral edge;
wherein the first lateral edge of the first upright outer wall is attached to the second lateral edge of the sidewall.

2. Cutlery basket according to claim 1, wherein the compartment is covered by a lid, the lid having openings to support the cutlery.

3. Cutlery basket according to claim 2, having a second upright wall in a distance of the first upright outer wall also defining a border of the compartment, the cutlery basket comprising at least one guide to allow the lid to be moved in a position parallel and proximal to the second upright wall.

4. Cutlery basket according to claim 1, having a second upright wall, wherein at least one of the upright walls has an offset border to increase the structural stability of the cutlery basket.

5. Cutlery basket according to claim 4, wherein the offset border is thicker than the at least one of the upright walls.

6. Cutlery basket according to claim 5, wherein the offset border comprises the at least one guide for the lid.

7. Cutlery basket according to claim 3, wherein the guide and the lid mutually engage by a protrusion and a groove that allows the sliding and rotating movement against the protrusion.

8. Cutlery basket according to claim 7 that has a rectangular footprint and a vertical outer wall, wherein the guide runs parallel to the vertical direction of the outer wall and the protrusion allows at least 90° rotation of the lid.

9. Cutlery basket according to claim 8, wherein the at least one guide comprises at least two guides defined along respective ones of the first upright wall and the second upright wall.

10. Cutlery basket according to claim 9, wherein each guide is located in a respective one of the two upright walls.

11. Cutlery basket according to claim 10, wherein each guide is provided in the form of a rail, a groove, or a slot.

12. Cutlery basket according to claim 11, wherein the slot is L-shaped and a longer leg of the L-shape is positioned in the vertical direction.

13. Cutlery basket according to claim 12, wherein the lid is at least partially made from a soft material to allow easy loading and unloading of cutlery.

14. Cutlery basket according to claim 7, wherein the lid is arranged to be positioned outside of the compartment.

15. Cutlery basket according to claim 1, further comprising:
a lid having openings to support the cutlery, the lid being configured to cover the compartment; and
a base opposite the lid relative to the compartment;
wherein the first opening of the first upright outer wall is vertically positioned between the lid and the base relative to a vertical direction defined by an axis spanning the lid and base.

16. Cutlery basket according to claim 1, further comprising:
a handle comprising an opening configured to be gripped by a user.

17. A cutlery basket for a dishwasher at least comprising:
a first upright outer wall defining an outside border of a compartment to accept cutlery,
the first upright outer wall in a first upper region having a first opening having the size of 40-60% of the first upright outer wall, the first opening providing access to an interior of the compartment, and
the first upright wall in a second lower region has plural openings of a size allowing to support the cutlery; and
a lid having openings to support the cutlery, the lid being configured to cover the compartment; and
a base opposite the lid relative to the compartment;
wherein the first opening of the first upright outer wall is vertically positioned between the lid and the base relative to a vertical direction defined by an axis spanning the lid and base.

18. A cutlery basket for a dishwasher at least comprising:
a first upright outer wall defining an outside border of a compartment to accept cutlery,
the first upright outer wall in a first upper region having a first opening having the size of 40-60% of the first upright outer wall, the first opening providing access to an interior of the compartment, and
the first upright wall in a second lower region has plural openings of a size allowing to support the cutlery;
a second upright wall; and
a handle comprising an opening configured to be gripped by a user, wherein the handle is configured to extend from the second upright wall.

19. The cutlery basket of claim 18, wherein the second upright wall is disposed opposite the first upright outer wall relative to the compartment.

* * * * *